US010781040B1

(12) United States Patent
Hankey

(10) Patent No.: US 10,781,040 B1
(45) Date of Patent: Sep. 22, 2020

(54) FRONT LOAD REFUSE CONTAINER AND LIFT POCKET ASSEMBLY

(71) Applicant: J. Daniel Hankey, Durant, OK (US)

(72) Inventor: J. Daniel Hankey, Durant, OK (US)

( * ) Notice: Subject to any disclaimer, the term of this patent is extended or adjusted under 35 U.S.C. 154(b) by 0 days.

(21) Appl. No.: 16/025,446

(22) Filed: Jul. 2, 2018

Related U.S. Application Data

(63) Continuation of application No. 14/529,444, filed on Oct. 31, 2014, now Pat. No. 10,011,424, which is a continuation of application No. 13/017,661, filed on Jan. 31, 2011, now Pat. No. 8,875,932.

(51) Int. Cl.
*B65F 1/12* (2006.01)
*B65F 1/02* (2006.01)
*B65F 1/14* (2006.01)

(52) U.S. Cl.
CPC ..... *B65F 1/1452* (2013.01); *B65F 1/02* (2013.01); *B65F 1/122* (2013.01); *B65F 2250/11* (2013.01)

(58) Field of Classification Search
CPC ..... B65F 1/122; B65F 1/125; B65D 88/54; B65D 88/56
See application file for complete search history.

(56) References Cited

U.S. PATENT DOCUMENTS

| | | | |
|---|---|---|---|
| 2,583,626 | A | 1/1952 | Buell |
| 3,451,453 | A | 6/1969 | Heck |
| 4,157,609 | A | 6/1979 | Schutz |
| 4,186,844 | A | 2/1980 | Swanson |
| 4,315,574 | A | 2/1982 | Forny et al. |
| 4,373,849 | A | 2/1983 | Robinson |
| 4,676,431 | A | 6/1987 | Teske et al. |
| 4,726,616 | A | 2/1988 | Schmidt |
| 4,955,501 | A | 9/1990 | Hodge |
| 5,118,000 | A | 6/1992 | Howell et al. |
| 5,330,071 | A | 7/1994 | Parker |
| D351,702 | S | 10/1994 | Breen |
| D351,703 | S | 10/1994 | Breen |
| 5,423,448 | A | 6/1995 | Pedigo |
| 5,490,606 | A | 2/1996 | Lombardo |
| D376,456 | S | 12/1996 | Presnell et al. |
| 5,878,904 | A | 3/1999 | Schweigert |
| 5,984,697 | A | 11/1999 | Moran et al. |
| D422,450 | S | 4/2000 | Conti |
| 6,146,048 | A | 11/2000 | Stibolt |
| D447,575 | S | 9/2001 | Shaw |
| D448,495 | S | 9/2001 | Lamberts |
| 6,293,064 | B1 | 9/2001 | Larson |
| 6,702,135 | B2 | 3/2004 | Pickler |
| 7,185,783 | B1 | 3/2007 | Miller |

(Continued)

OTHER PUBLICATIONS

Pynette Iron Works, Inc., "2016 Complete Marketing Book, Page 7 Item 8yd Front Load; p. 10 4yd Front low Profile 2 Lid", "www.poynetteironworks.com", Publisher: searched Jan. 2018, published 2016.

(Continued)

*Primary Examiner* — Andrew T Kirsch
(74) *Attorney, Agent, or Firm* — Gable Gotwals

(57) ABSTRACT

A front load refuse container made according to this invention has its four walls integrally formed out of a single piece of sheet metal. To form the walls, the single sheet is welded along a single vertical seam to form a circular-shaped ring. The circular-shaped ring is subjected to a swedging process that produces a rectangular-shaped ring with rounded corners.

5 Claims, 12 Drawing Sheets

(56) References Cited

U.S. PATENT DOCUMENTS

| | | | |
|---|---|---|---|
| 7,766,186 | B1 | 8/2010 | Brown |
| D645,907 | S | 9/2011 | Sandel et al. |
| 8,066,144 | B2 | 11/2011 | McNamara et al. |
| 8,123,061 | B1 | 2/2012 | Brown |
| D792,046 | S | 7/2017 | Hankey |
| 2002/0139079 | A1 | 10/2002 | Brady |
| 2004/0045239 | A1 | 3/2004 | Milu |
| 2004/0262320 | A1 | 12/2004 | Pruett |
| 2006/0060593 | A1 | 3/2006 | Maggio, Sr. et al. |
| 2009/0032545 | A1 | 2/2009 | Zeiler et al. |
| 2009/0179444 | A1 | 7/2009 | Apps et al. |
| 2011/0000382 | A1 | 1/2011 | Sherwood et al. |

OTHER PUBLICATIONS

Western Cascade Container, LLC, "Items: 1 yard poly waste container, 1.5 yard poly waste containers, 2 yard poly waste container", Publisher: searched Jan. 2018—copyright 2010.

Maxi, rachelmaxi.blogspot.com, Jun. 5, 2008, Publisher: http://rachelmaxi.blogspot.com/2008/06/upcoming-show-at-some-space-gallery_05.html.

Nailade; eat3d.com, "http://eat3d.com/forum/art-gallery/garbage-dumpster", Jul. 22, 2010.

7 / 12

FRONT LOAD REFUSE CONTAINER AND LIFT POCKET ASSEMBLY

BACKGROUND OF THE INVENTION

This invention generally relates to refuse hauling and, more particularly, to front load refuse containers sized in the range of 2 to 10 cubic yards and methods of their manufacture.

Front load refuse containers (also called bins, cans, or dumpsters) require a significant amount of cutting and welding during their fabrication. The sheets, which make up the opposing side- and end-walls and floor, must be cut-to-size, transported to a welding operation, mated along the edges, and welded together. The structural tubing, which makes up the top rail and provides added rigidity and structural support to the wells, must also be cut-to-size, transported to a welding operation, fitted to the walls and to an adjacent rail, and welded to the walls and to each other. The sheets that make of the lift pockets which receive the forks of a refuse truck and typically include a U-shaped channel portion and gusset portions, must also be cut-to-size, transported to a welding operation, mated along the edges, welded together and then welded to the end walls.

The total weld length required to assemble the side- and end-walls and the lift pockets can be substantial. For example, assembling the walls of a 2-yard dumpster requires about 144 inches (12 feet) of weld length and a 10-yard dumpster requires about 360 inches (30 feet) of weld length. Assembling a lift pocket that is about 27 inches in length requires about 225 inches or so of weld length (almost 19 feet).

The end result of the prior art designs and fabrication methods is a container that is costly and time consuming to produce, not visually appealing because of the welded corners, and a potential safety hazard during fabrication and use because of the sharp corners and edges. Further, the lift pockets, which take a beating from refuse truck forks, can fail at the weld seams. Additionally, although not designed to provide a standing surface, the lift pockets invite standing on because either gussets are not used or, more typically, the gussets' flat surfaces are arranged at a very shallow angle relative to the end wall. The pockets (as well as the top rail of the container) also provide a shelf for vandals to place rocks or other heavy objects. These objects fall off the pocket or rail as the container is being lifted by a refuse truck, damaging the truck or, worse, injuring its driver.

A need exists for a front load refuse container that requires less cutting, welding, and material handling during its fabrication and assembly; improves safety; and provides a more aesthetically pleasing design.

SUMMARY OF THE INVENTION

A front load refuse container made according to this invention has its four walls integrally formed out of a single piece of sheet metal. To form the walls, the opposing ends of the single sheet are aligned and joined to form a circular-shaped ring. Next, the circular-shaped ring is subjected to a swedging process that produces a rectangular-shaped ring with rounded corners. This rectangular-shaped ring forms the walls of the container body.

During fabrication of the container, the rectangular-shaped ring may be fitted on with complementary-shaped top rail tubing. The top rail tubing, which is preferably formed by passing a length of structural tubing through a die set in order to form a rectangular-shaped ring, also has a single vertical weld seam. The top rail tubing is then welded to the lower end of the rectangular-shaped ring. Once the floor is welded to the upper end of rectangular-shaped ring, the container is placed right side up. The top rail and floor weld seams remain hidden from view.

To form the circular-shaped ring, a ring-making machine may be employed that has an arm which receives the single sheet so that half the longitudinal length of the sheet lies to each side of the arm. The arm is then raised up by a slide assembly so that each half of the sheet drapes vertically down with the ends of the sheet at or near floor level. Each sheet end is then clamped to a drop away table which lies opposite and adjacent to that end. The pair of drop away tables is then rotated from the vertical to the horizontal position so that the two ends are at an appropriate spacing for welding. A seam welder welds the two ends together to form the circular-shaped ring.

A rack-and-pinion gear arrangement may be used to move the arm and circular-shaped ring through a 270° arc in order to center the ring over a swedging machine. The slide assembly then lowers the ring onto the swedging machine.

The swedging machine has a pair of opposing posts about which the circular-shaped ring is placed. One post in each pair is fixed and is connected to the cylinder end of a pair of hydraulic cylinders. The other post is moveable and is connected to the ram end of the hydraulic cylinders. The fixed and moveable posts and spaced apart such that when the circular-shaped ring is positioned over it, there is relatively little clearance between the post corners and the ring. As the cylinders move between a retracted and extended position, the circular-shaped ring is transformed into a rectangular-shaped ring. As mentioned above, a top rail tubing and floor may then be welded to the rectangular-shaped ring.

A front load refuse container made according to this invention may also include a lift pocket assembly whose pocket portion and forward gusset are each formed from a single sheet. The upper and lower face surfaces of the lift pocket are angled relative to the sidewall of the container, preferably at about a 25° angle from vertical, thereby eliminating the appearance of a step and preventing rocks or heavy objects from remaining on the lift pocket.

Objects of this invention are to:

1. eliminate the amount of cutting and welding typically required to fabricate a front load container;
2. reduce the number of process steps and amount material handling involved;
3. error-proof the fabrication process by reducing the occurrence of fit and weld problems;
4. reduce the process time, overall cycle or flow time, and cost of producing a front load container;
5. increase the safety of the fabrication process;
6. eliminate potential safety hazards by rounding off sharp corners and edges;
7. reduce or eliminate product misuse by providing a lift pocket assembly that prevents or discourages standing on;
8. reduce the amount of material required to fabricate a lift pocket assembly;
9. improve the strength of the container and lift pocket by eliminating weld seams; and
10. improve the aesthetics the container by providing rounded corners and fewer visible weld seams.

ELEMENT LISTING

Elements shown in the above drawings are referenced in the Detailed Description as follows:

| | | |
|---|---|---|
| 10 | Refuse container | 77 First slide |
| 11 | Container body | 79 Lower end of 77 |
| 13 | End wall | 81 Upper end of 77 |
| 15 | Side wall | 83 Second slide |
| 17 | Corner formed by 13 and 15 | 85 Upper end of 83 |
| 19 | Rounded or radial corner | 87 Drop away table |
| 21 | Floor | 89 End of 87 |
| 23 | Top rail tubing | 91 Hydraulic cylinder |
| 25 | Bottom end of 23 | 93 Rack-and-pinion gear |
| 27 | End of 23 | 95 Longitudinal centerline of 93 |
| 29 | Weld seam of 23 | 97 Hydraulic cylinder |
| 30 | Sheet | 99 Rod end |
| 31 | Half | 100 Swaging machine |
| 33 | End | 101 Fixed post |
| 35 | Lateral centerline | 103 Moveable post |
| 37 | Longitudinal edge portion | 105 Bracing or fence surface |
| 39 | Lateral edge portion | 107 Flat outer surface of 101, 103 |
| 40 | Circular-shaped ring | 109 Rounded or radial corner |
| 41 | Weld seam | 111 Hydraulic cylinder |
| 43 | Rectangular-shaped ring | 113 Cylinder end |
| 45 | Inner wall surface | 115 Ram end |
| 47 | Upper end | 120 Lift pocket |
| 49 | Lower end | 121 Single sheet |
| 51 | Uppermost peripheral surface | 123 Channel or pocket |
| 70 | Ring-making machine | 125 Front face |
| 71 | Lifting surface or arm | 127 Upper face |
| 72 | Forward end | 129 Lower face |
| 73 | Rearward end | 131 Longitudinal edge |
| 74 | Latch | 133 Forward end |
| 75 | Slide assembly | 135 Blunderbuss-shaped gusset |
| | | 137 Rearward end |
| | | 139 Triangular-shaped gusset |

DETAILED DESCRIPTION OF THE PREFERRED EMBODIMENTS

Figure 4:
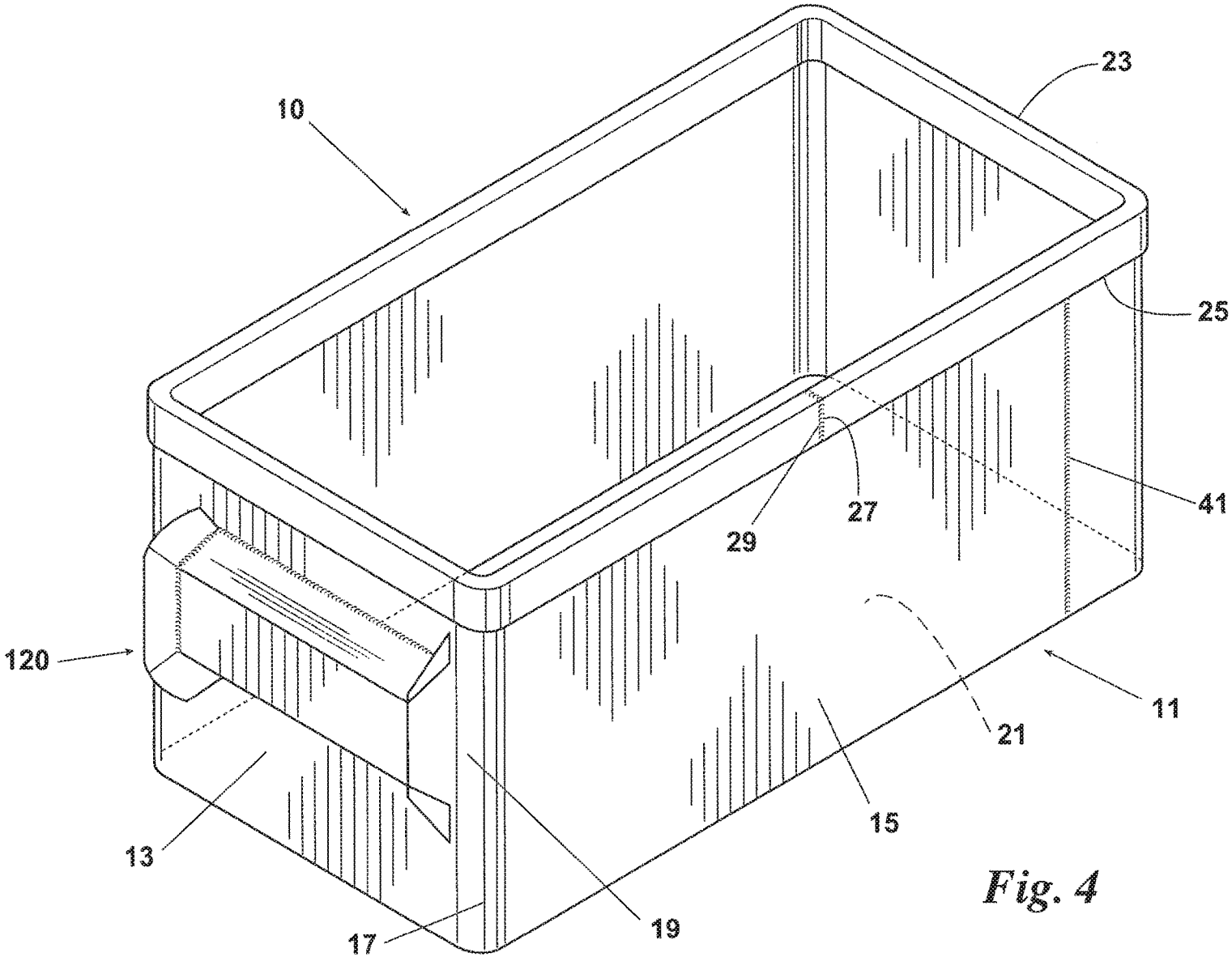
FIG. 4 is rear isometric view of a preferred embodiment of a refuse container made according to this invention. The walls are formed from a single sheet that has been welded into a circular-shaped ring and subjected to a swedging process to form a rectangular-shaped ring with rounded corners. The weld used to make the circular-shaped ring is the only weld seam visible on the body of the container.
Figure 7:
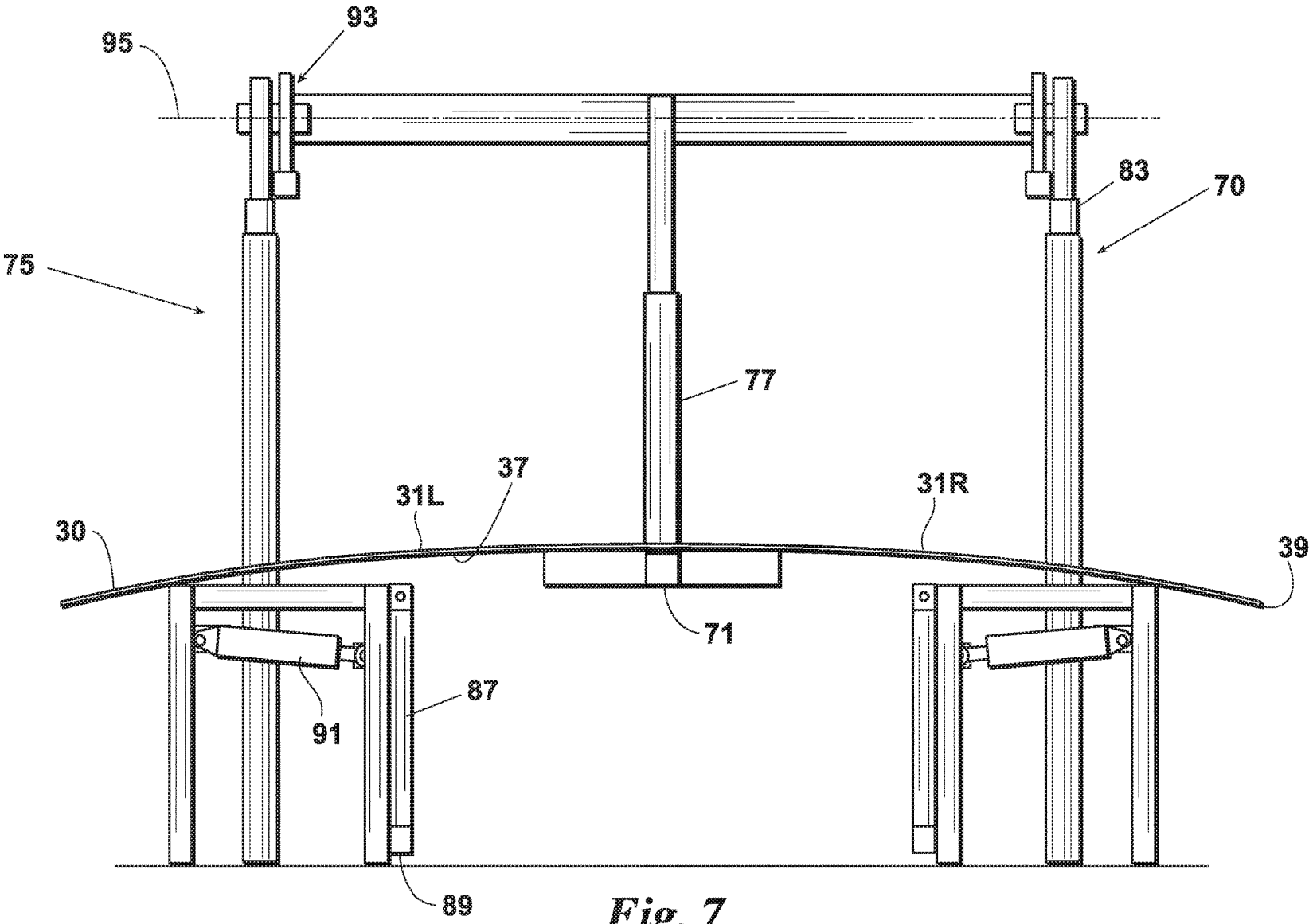
FIG. 7 is a front elevation view of a preferred embodiment of a machine used to form a single sheet into a circular-shaped ring for a subsequent swedging operation. The machine is in the sheet load position. In this position, an arm extends forwardly of the machine and receives a single sheet so that half of the sheet lies to each side of the arm.
Figure 8:
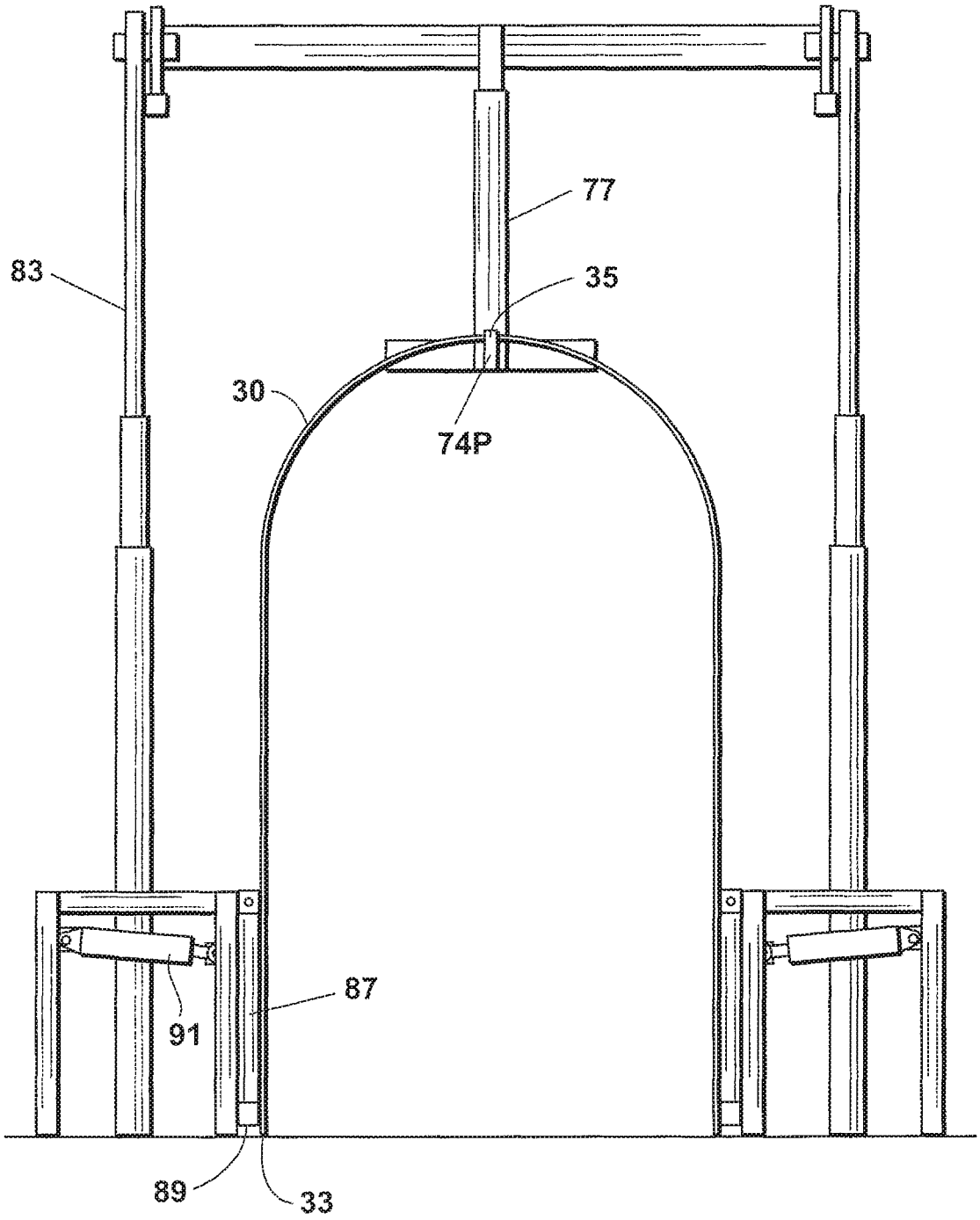
FIG. 8 is a front elevation view of the ring-making machine of FIG. 7 in the sheet lift position. As the arm is raised up the ends of the sheet begin to drape down over the arm. Once the sheet has been raised to the point where each of hits ends run parallel to but still touch the floor, each end is clamped to a vertically oriented drop away table which lies opposite to and adjacent that end.
Figure 9:
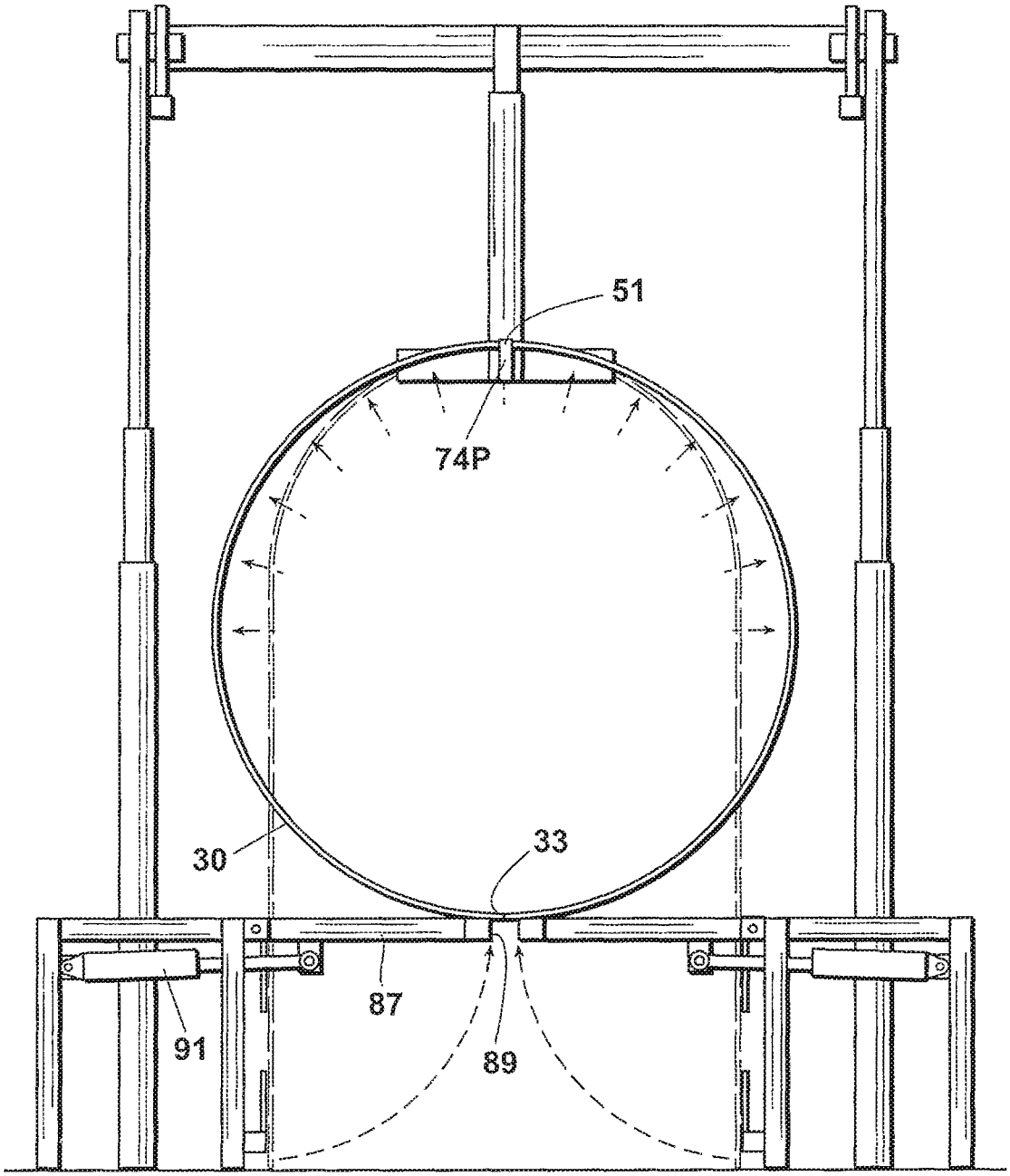
FIG. 9 is a front elevation view of the ring-making machine of FIG. 7 in the sheet seam weld position. The pair of drop away tables has been moved from the vertical to the horizontal position in order to place the ends of the sheet a distance apart that is suitable for seam welding. A seam welder then welds the two ends together to form the circular-shaped ring.
Figure 10A:
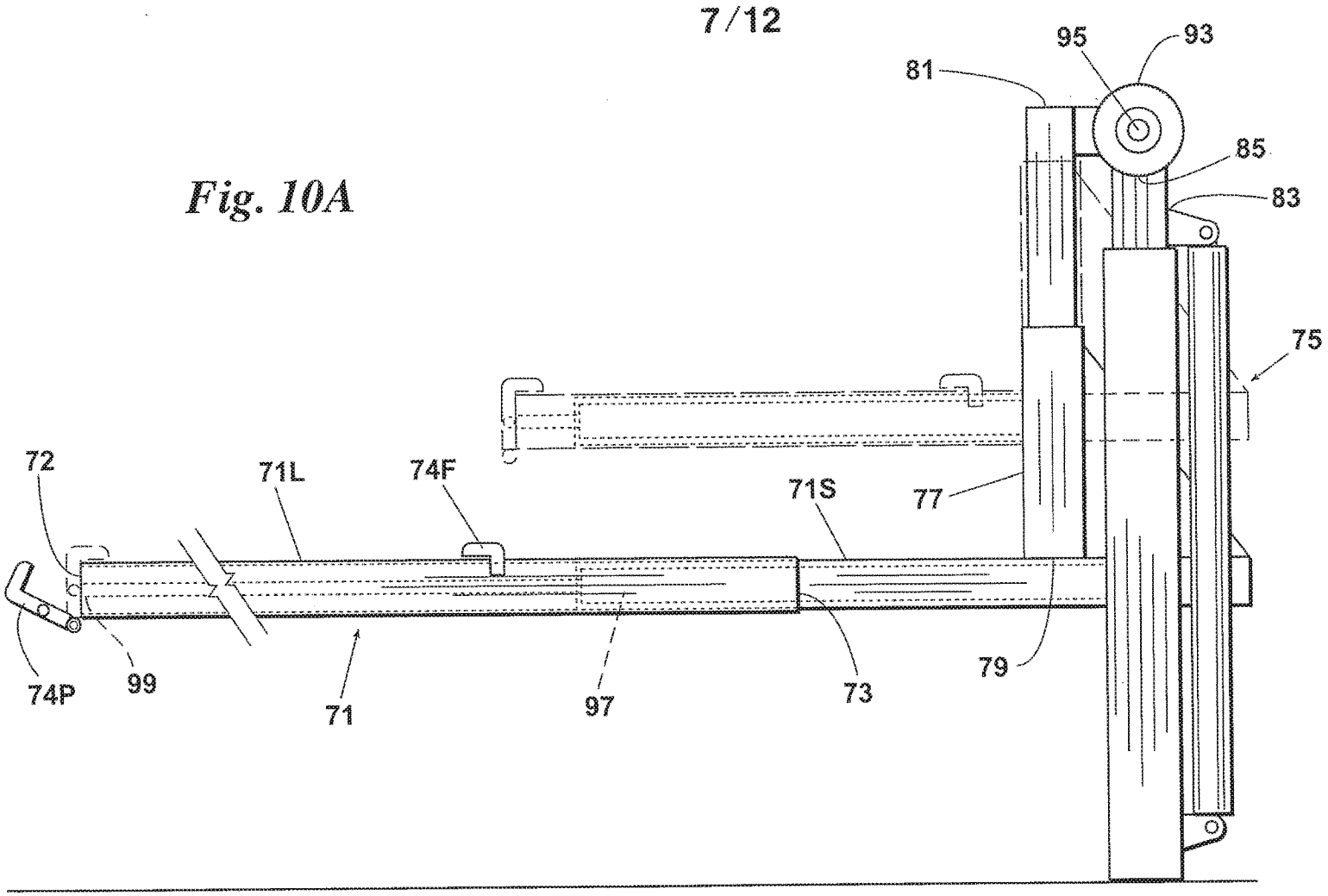
FIG. 10A is a side elevation view of the ring-making machine of FIG. 7 illustrating the adjustable length lifting arm and the vertical movement of the first slide between a retracted and extended position
Figure 10B:
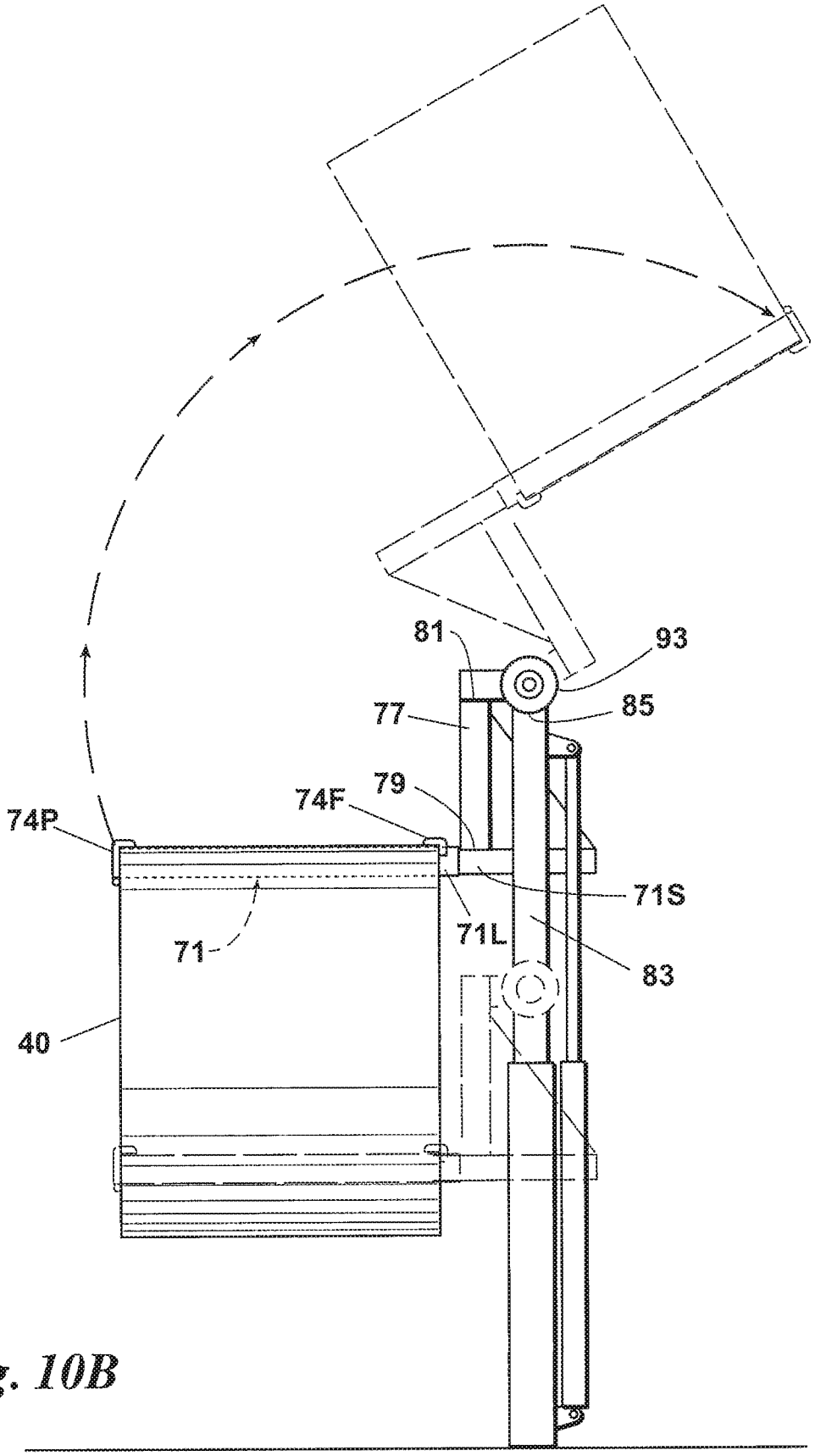
FIGS. 10B-E are side elevation views of the ring-making machine of FIG. 7 as it moves the circular-shaped ring through a 270° arc.
Figure 10C:
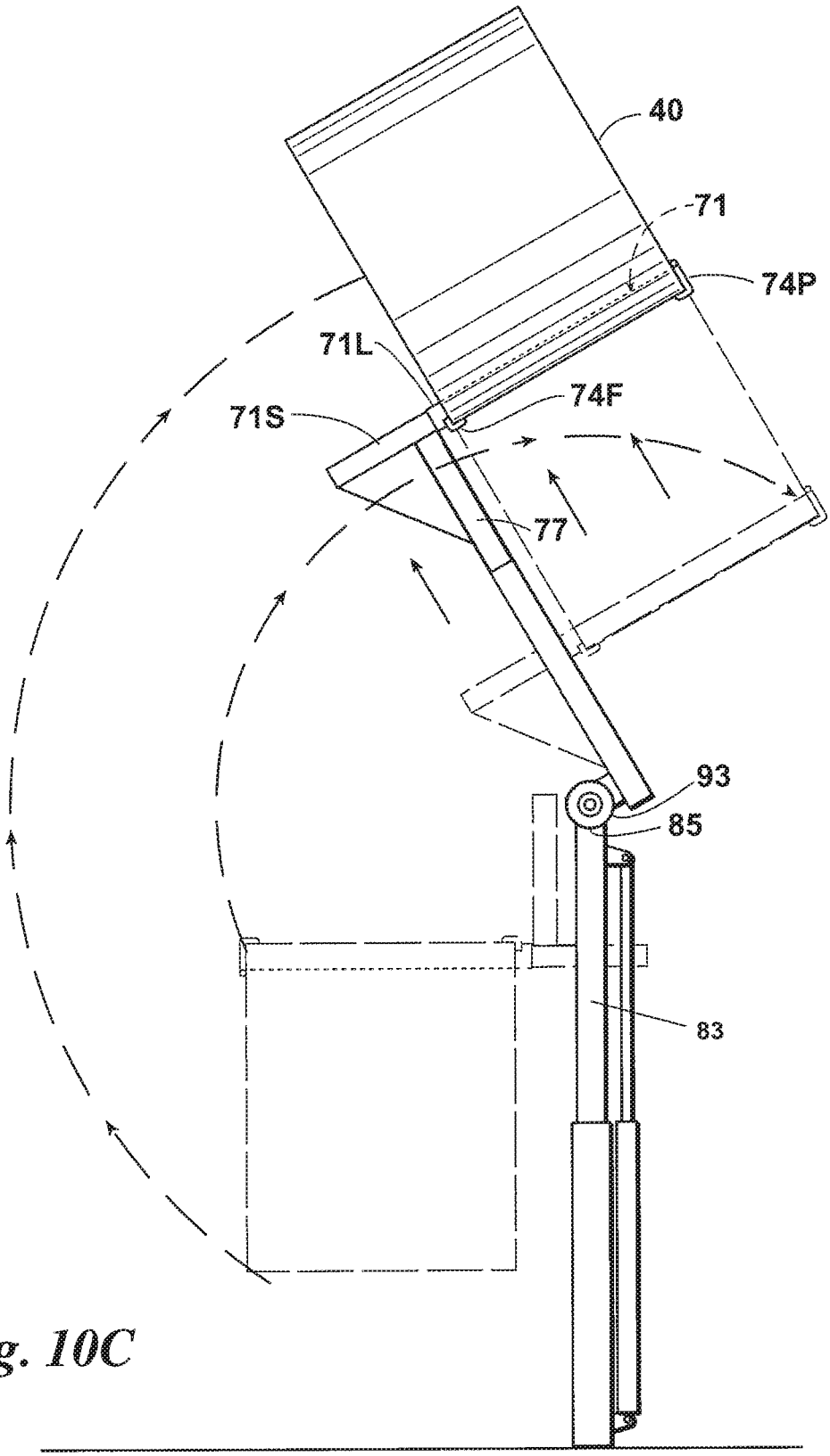
Figure 10D:
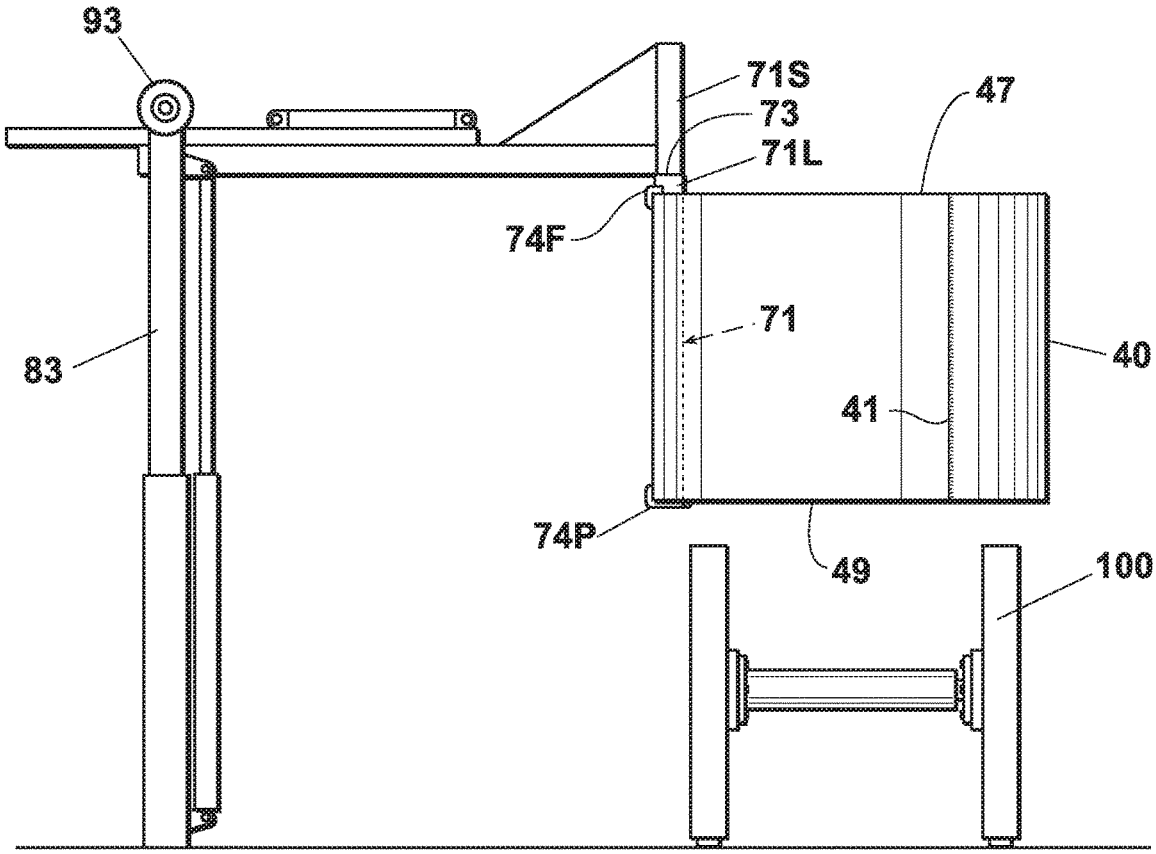
Figure 10E:
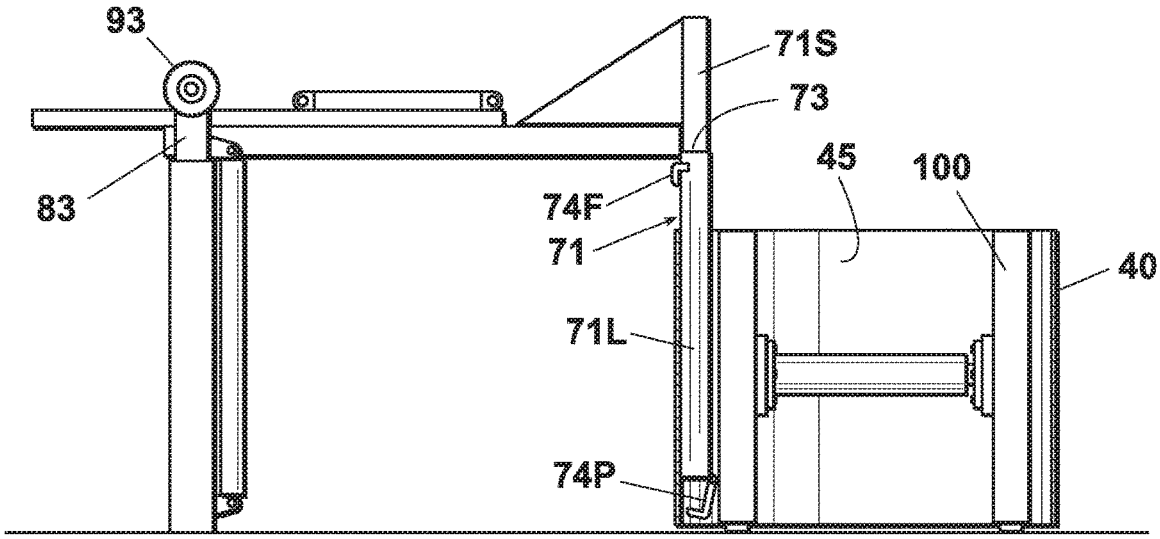
Figure 11:
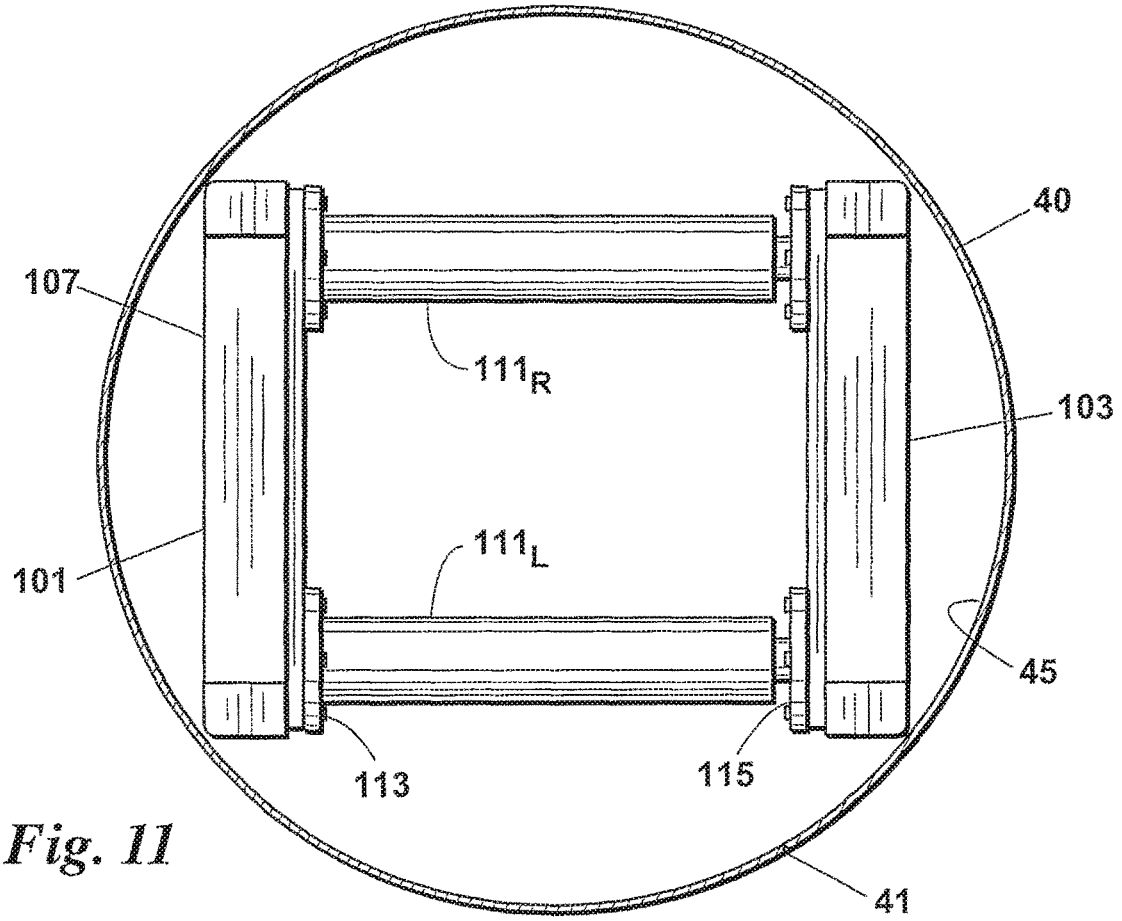
FIG. 11 is a top plan view of the circular-shaped ring positioned about a swedging machine that has a pair of opposing posts. One post in each pair is fixed and is connected to the cylinder end of a hydraulic cylinder. The other post is moveable and is connected to the ram end of the hydraulic cylinder.
Figure 12:
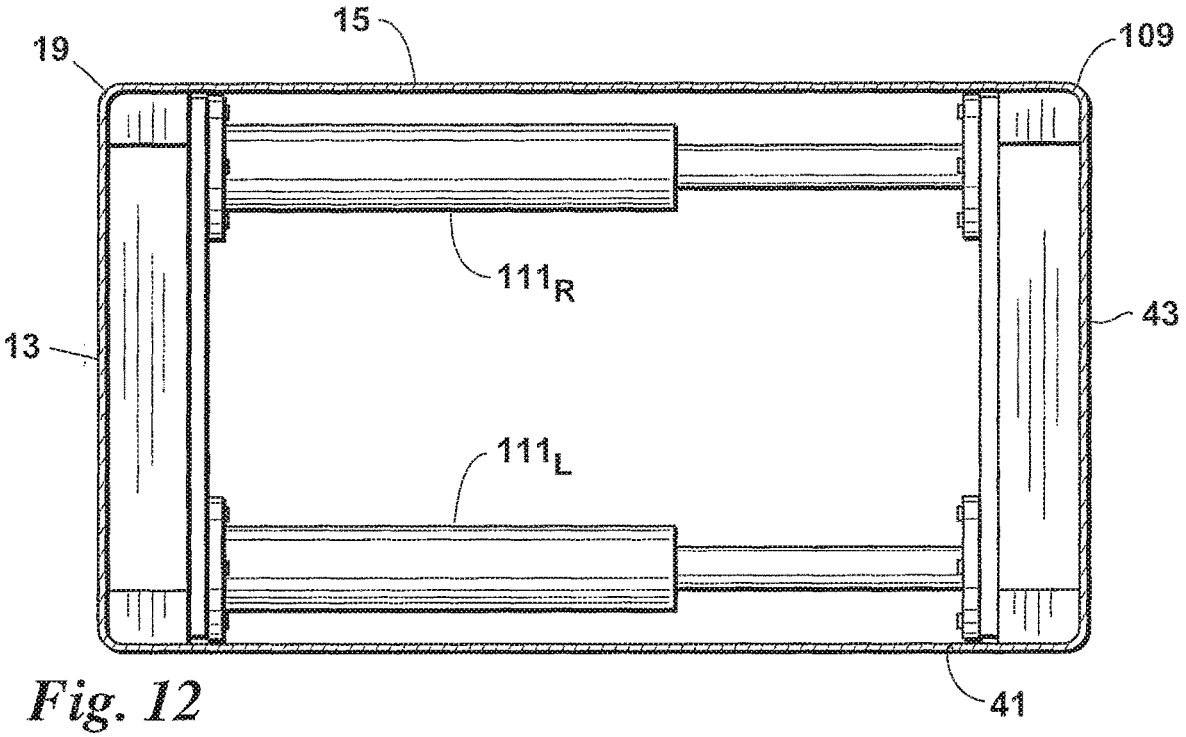
FIG. 12 is a top plan view of the swedging machine of FIG. 11 illustrating the cylinders in an extended position and transforming the circular-shaped ring into a rectangular-shaped ring. A top rail and floor may then be welded to the rectangular-shaped ring.
Figure 15:
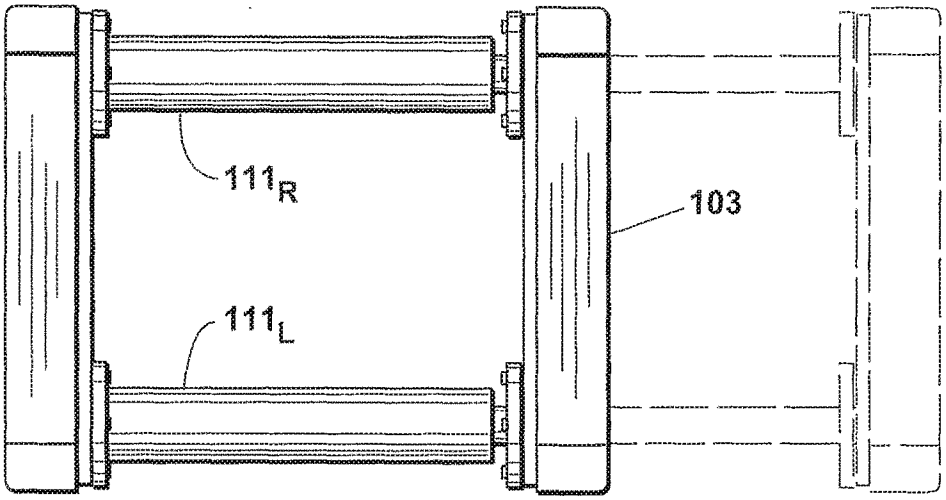
FIG. 15 is a top plan view of the swedging machine of FIG. 11 illustrating the cylinders extending between a first (retracted) position and a second (extended) position.
Figure 13:
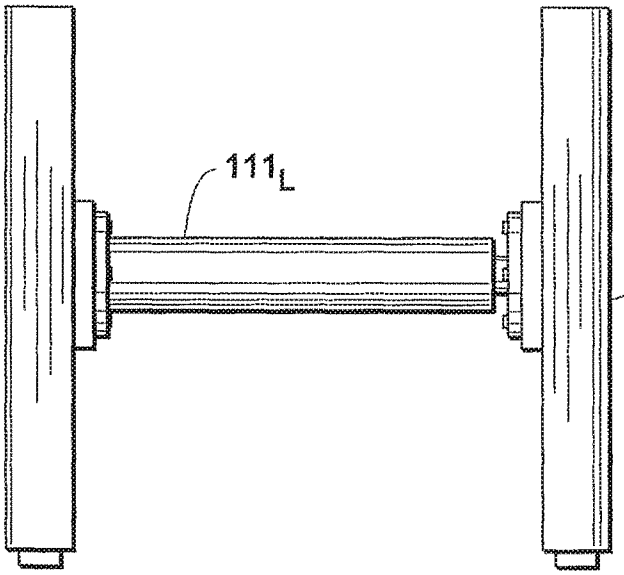
FIG. 13 is a front elevation view of the swedging machine of FIG. 11.
Figure 14:
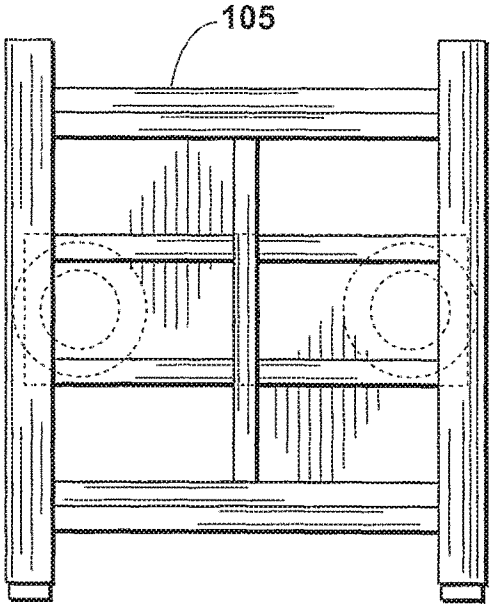
FIG. 14 is a right side elevation view of the swedging machine of FIG. 11.

Referring to the drawings, and first to FIG. 4, a front load refuse container 10 made according to this invention has a container body 11 made up of two opposing end walls 13 and two opposing side walls 15 that, instead of being four individually cut-to-size and welded pieces (see FIG. 1), are integrally formed from a single steel sheet 30. Single sheet 30 is of a type and gauge typically used in fabricating refuse containers and is preferably cut to a desired dimension using a plasma cutter. The height and length of the cut sheet 30 is such that, once fabricated into container body 11, the container body 11 provides the volume or refuse capacity desired for container 10 (e.g. 2 cubic yards, 10 cubic yards).

Figure 1:
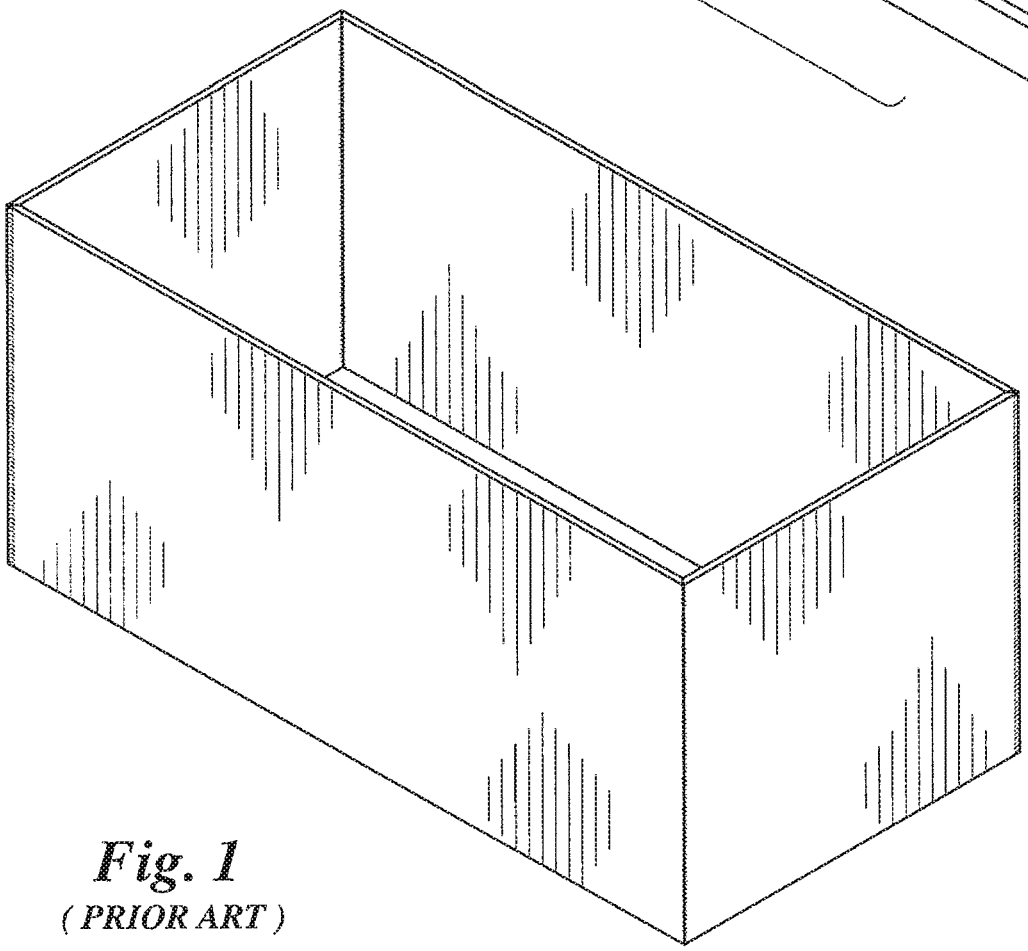
Fig. 1 ( PRIOR ART )
FIG. 1 is an isometric rear view of a prior art refuse container. Each wall is formed from a single sheet cut-to-size and then welded along its edges to other sheets cut-to-size.

Because sheet 30 can be cut-to-size within a 1/16 to 1/32-inch tolerance, using a single sheet 30 to form container body 11 significantly reduces the overall tolerance relative to that experienced with prior art container bodies, with their four individually cut-to-size, fitted and welded sheets (see FIG. 1). Further, integrally forming container body 11 out of single sheet 30 avoids material handling and fitting problems. When fabricating the prior art container bodies, the sheets which form each wall must be stood on edge during fitting and welding. This makes it extremely difficult to hold tight tolerances, much less obtain a tolerance on each side that is one-quarter of the 1/16- or 1/32-inch total tolerance achieved by container body 11 when integrally formed.

Referring now to FIGS. 7 to 10A, after sheet 30 is cut to its desired length, the opposing ends 33 of sheet 30 are joined together to form a circular-shaped ring 40 having a single vertical weld seam 41. To form the circular-shaped ring 40, a preferred method is to lift sheet 30 so that each sheet longitudinally extending half 31L, 31R lies substantially in a vertical plane with ends 33 running parallel to but touching the floor. The sheet ends 33 are then brought together and seam welded.

Lifting the sheet 30 so that its ends 33 may be seam welded can be accomplished by way of a ring-making machine 70. Ring-making machine 70 includes a horizontally oriented lifting surface or arm 71 that is in communication with and arranged perpendicular to a slide assembly 75. Lifting arm 71 is sized to handle the maximum width sheet 30 that may be formed into a container 10. Preferably, lifting arm 71 is an adjustable length arm, extending or retracting between a first and second position as needed to accommodate different widths of sheet 30. For example, lifting arm 71 may have an exposed working length of about 12 to 13 feet at its maximum and about 7 feet at its minimum. As explained below, because of the need to lower sheet 30 to or just above floor level when sheet 30 has been welded into a circular-shaped ring 40, lifting arm 71 should be able to extend about 20 inches or so beyond the maximum width sheet 30 that it can accomplish this lowering task.

Slide assembly 75 vertically raises and lowers the lifting arm 71. Sheet 30 is placed over the lifting arm 71 so that the lateral centerline 35 of sheet 30 is substantially co-axial to arm 71. A longitudinal edge portion 37 of sheet 30 is then removably secured to the arm 71 at its forward end 72 by way of a pivoting latch 74P or other similar means. An opposing longitudinal edge portion 37 is secured to arm 71 at its rearward end 73 by a fixed latch 74F. In this loaded and secured position, the lateral centerline 35 of sheet 30 in one preferred embodiment is about 45 inches or so above the floor.

In a preferred embodiment, lifting arm 71 included a hydraulic cylinder 97 mounted inside and affixed to a tube 71S (about a 3½ inch tube) with the rod end 99 of the cylinder 97 attached to a 71L (about a 4-inche tube) and the pivoting latch 74P. As the cylinder 97 extends from its retracted position, latch 74P moves to its opened, non-latching position and tube 71L extends until the fixed latch 74F is fully on top of the sheet 30 (tube 71L now being under the sheet 30). When cylinder 97 retracts, the pivoting latch 74P moves to its closed, latched position and tube 71L retracts along with the sheet 30.

Slide assembly 75 is sized to provide a total vertical travel distance that accommodates one-half the maximum length sheet 30 used to form the largest-volume container 10 desired to be formed. The slide assembly 75 includes a first slide 77 and a second slide 83 that provides this total vertical travel distance. First slide 75 raises and lowers lifting arm 71. A lower end 79 of first slide 77 is in communication the arm. Second slide 83 raises and lowers a rack-and-pinion gear arrangement 93. An upper end 85 of second slide 83 is in communication with the rack-and-pinion gear arrangement 93. Second slide 83 also raises and lowers first slide 77. An upper end 81 of first slide 77 is in communication with the rack-and-pinion gear arrangement.

The slides 77, 83 preferably have different lengths of travel. In a preferred embodiment, second slide 83 has about three times the travel distance of first slide 77 (e.g., 72 inches and 24 inches of travel, respectively). To lift sheet 30, first slide 77 moves between an extended and retracted position. When the first slide 77 is in its extended position, the slide 77 is at its maximum length. As slide 77 moves to the retracted position, lifting arm 71 moves away from the floor and lifts sheet 30. Once slide 77 is fully retracted, the second slide 83 moves between a retracted and extended position and further lifts sheet 30.

When the slides 75, 83 have lifted sheet 30 to an appropriate height, each sheet half 31L, R is draped over lifting arm 71 and hanging substantially vertically relative to the floor with sheet ends 33 running parallel to but still touching the floor. With sheet 30 in this position, the sheet ends 33 can be easily manipulated and aligned end-to-end for welding.

By way of example, if sheet 30 is sized to make a 3 cubic yard container 10, sheet 30 is about 221 inches long and about 3 feet wide. Slide assembly 75 lifts sheet 30 a total vertical distance so that its lateral centerline 35 is located about 9 feet above the floor. In a preferred embodiment, first slide 77 has about 24 inches of travel and second slide 83 has about 72 inches of travel. When first slide 77 is in its extended position, the slide 77 places the lateral centerline 35 of sheet 30 and, therefore, the upper surface of lifting arm 71, about 45 inches above the floor. When fully retracted, first slide 77 places lateral centerline 35 about 69 inches above the floor. Second slide 83 then extends about 39 inches to place lateral centerline 35 about 108 inches (9 feet) above the floor. If slide 83 extends its full length of travel, it places the lateral centerline 35 of sheet 30 about 141 inches or almost 12 feet above the floor.

To align the sheet ends 33 for welding, a lateral edge portion 39 located toward each end 33 is removably secured by way of a clamp (not shown) or other similar means to an opposing end 89 of a drop away table 87. Each drop away table 87 pivots or rotates between a vertical (first) position and a horizontal (second) position. When in the vertical position, the pair of drop away tables 87 is located about 6 feet apart and lateral edge portion 39 is removably secured to the respective adjacent drop away table 87. A stop (not shown) of appropriate length, such as a piece of pipe or square tubing, may be positioned on the floor between the opposing drop away tables 87 to provide a visual indicator as to when sheet 30 has been lifted to an appropriate height to place sheet ends 33 in proper position for being removably secured to the drop away tables 87.

Once the sheet ends 33 are secured to the drop away tables 87, the tables 87 can be pivoted or rotated from the vertical position to the horizontal position. A hydraulic cylinder 91 may be used to accomplish this rotation. When in the horizontal position, the ends 89 of the tables 87 are about 2 to 4 inches apart and the sheet ends 33 are spaced an appropriate distance for receiving a seam weld. In a preferred embodiment, the ends 33 are spaced apart about 1/64 inch.

The above arrangement places the sheet ends 33 in the right relationship to one another every time. A seam welder (not shown) welds the ends 33 to form circular-shaped ring 40. Using a seam welder in combination with ring-making machine 70 is much faster than using a robotic welder. The robotic welder must cycle to "touch sense" the ends, position itself accordingly and then weld.

Now that circular-shaped ring 40 has been formed, the clamps or means securing ring 40 to drop away tables 87 can now be removed and the drop away tables 87 can be returned to the vertical position. The circular-shaped ring 40 is ready for transport to a swedging machine 100.

Referring now to FIGS. 10B to 10E, rather than going through the steps of (1) retracting slide assembly 75, (2) removing circular-shaped ring 40 from the lifting arm 71, and (3) moving the ring 40 to the swedging machine 100, ring 40 preferably is transported to the swedging machine 100 by way of the rack-and-pinion gear arrangement 93. By locating the swedging machine 100 directly behind ring-making machine 70, ring 40 can be rotated through a 270° arc and then lowered onto the swedging machine 100. Rack-and-pinion gear arrangement 93 accomplishes this rotation.

When rack-and-pinion gear arrangement 93 has rotated lifting arm 71 through 90° of rotation, the clamp end 73 of lifting arm 71 is at a height above the floor equal to the height of the longitudinal centerline 95 of gear arrangement 93 plus the exposed working length of arm 71. When the gear arrangement 93 has rotated lifting arm 71 through 180° of rotation, the total height equals the height of the longitudinal centerline 95 of gear arrangement 93 plus the length of first slide 77 in its fully retracted position plus the diameter of circular-shaped ring 40.

Returning to the 3 cubic-yard container example and assuming the vertical height of the longitudinal centerline 95 of the gear arrangement 93 is about 113 inches above the floor when second slide 83 fully retracted, the following rotation heights result. Immediately following seam welding, the longitudinal centerline 95 is about 152 inches above the floor and the uppermost peripheral surface 51 of circular-shaped ring 40 lies entirely below this centerline 95 at a height of about 108 inches. Because the diameter of circular-shaped ring 40 is slightly less than 6 feet, second slide 83 can be retracted the 39 inches it had previously extended. First slide 77 can remain in its fully retracted position because in this position its length is at a minimum. Therefore, at 0° of rotation, the total height is the height of the longitudinal centerline 95 of gear arrangement 93 or 113 inches.

At 90° of rotation, the clamp end 73 of lifting arm 71 is at a height of 197 inches—the 113-inch height of longitudinal centerline 93 plus the 84-inch working length of arm 71. At 180° of rotation, the total height is 222 inches or 18.5 feet, the sum of the 113-inch height of the longitudinal centerline 95, the 39-inch length of first slide 77, and the (approximate) 70-inch diameter of circular-shaped ring 40. At 270° of rotation, the height is equal to that of 90° of rotation.

Referring now to FIGS. 10D to 15, after circular-shaped ring 40 has been rotated through 270°, it is substantially centered over swedging machine 100. First slide 77 is extended to its full length to lower ring 40 to a height of about 20 inches above the floor. Lifting arm 71 may then extend to lower ring 40 to the floor or to a height about 1 inch above the floor in order to receive top rail tubing 25. Alternately, but not preferred, swedging machine 100 may include means such as a post ledge or angle bracket (not shown) for maintaining ring 40 at a desired height above the floor or suitable material handling equipment such as an overhead hoist (not shown) may be used to lower ring 40 to the floor.

In order to for ring-making machine 70 to clear swedging machine 100, circular-shaped ring 40 is released from lifting arm 71 and first slide 77 retracts to move the arm 71 vertically upward. The second slide 83 may then extend to further move arm 71 up and away. Arm 71 may then be rotated through 270° and placed in position to receive a new sheet 30.

Swedging machine 100 includes two pairs of opposing corner posts 101, 103 connected by way of hydraulic cylinder 111. Posts 101 are spaced-apart fixed posts connected to one another by bracing or fence surface $\mathbf{105}_F$. Fence surface 105 is substantially parallel to the flat outer wall surfaces 107 of each post 101. Each post 101 connects to a cylinder end 113 of a pair of hydraulic cylinders $\mathbf{111}_{U\&L}$. The other posts, posts 103, are spaced-apart moveable posts having a similar bracing or fence surface 105*m* spanning between them. Each post 103 connects to a ram end 115 of the pair of hydraulic cylinders $\mathbf{111}_{U\&L}$. The between-post spacing of post pair 101 and post pair 103 is the spacing required to provide a desired width of container body 11. In a preferred embodiment, this between-post spacing was about 41 inches (the distance between the flat outer surfaces 107 of the pair of posts 101, 103, respectively).

Each post 101, 103 has a rounded or radial corner 109 for forming the rounded or radial corner 19 of container body 11. When each pair of hydraulic cylinders $\mathbf{111}_{U\&L}$ is in a first (fully or partially retracted) position, the radial corner 109 resides just inside the opposing inner wall surface 45 of circular-shaped ring 40. A multiple of one to two times the thickness of sheet 30 is an appropriate spacing between the outer rounded edge 109 of the posts 101, 103 and an opposing inner wall surface 53 of the ring 40.

The working height of each post 101, 103 is at least equal to the maximum height of sheet 30 so that no portion of circular-shaped ring 40 extends above or below the posts 101, 103. In a preferred embodiment, the total height of each post 101, 103 is about 47 inches. As the pair of hydraulic cylinders $\mathbf{111}_{U\&L}$ moves between the first position and an extended second position, the cylinders $\mathbf{111}_{U\&L}$ pull ring 40 against fixed posts 101 and fence surface $\mathbf{105}_F$ and push moveable posts 103 and fence surface 105*m* into ring 40, thereby producing a rectangular-shaped ring 43.

In a preferred embodiment, the pair of hydraulic cylinders $\mathbf{111}_{U\&L}$ has about 20 inches of total travel. When the pair of hydraulic cylinders $\mathbf{111}_{U\&L}$ is fully retracted, the distance between the opposing flat outer wall surfaces 105 of opposing posts 101 and 103 is about 52 inches. When the pair of hydraulic cylinders $\mathbf{111}_{U\&L}$ is fully extended, this distance increases to about 72 inches.

After rectangular-shaped ring 43 is formed, a floor 21 is welded to the upper end 47 of the rectangular-shaped ring 43 (which, in turn, becomes the lower end of container body 11). A top rail tubing 23 is welded to the lower end 49 of ring 43 (which, in turn, becomes the upper end of container body 11). Preferably, ring 43 sits inside the top rail tubing 23 about ¼ inch and the top rail tubing 23 is welded on its bottom end 25 so that the weld is not visible to a user when container body 11 is in use. One vertical weld seam 29 connects the opposing ends 27 of the top rail tubing 23. Vertical weld seam 29 and vertical weld seam 41 are preferably located on the rear side wall 15 side of container body 11.

During the floor 21 and top rail tubing 23 welding operations, pressure is still being applied by the pair of hydraulic cylinders $\mathbf{111}_{U\&L}$. However, rectangular-shaped ring 43 will hold its shape once the cylinders $\mathbf{111}_{U\&L}$ begin to retract from their extended position even if no floor 21 or top rail tubing 23 is installed.

The process described so far reduces the amount of cutting and welding to form a container body by about 35 to 40%. The weld length for container body 11, for example, is one-fourth the weld-length of an equivalent-sized old-style container in which the walls are fabricated as individual sheets and welded together. The amount of labor is also significantly reduced. Fabricating the prior art container body of FIG. 1 requires about 12 workers. Fabricating container body 11 requires no more than 4 workers. Additionally, the amount of time required to weld seam 41 using a seam welder in combination with ring-making machine 70 is cut in half when compared to welding seam 41 with a robotic welder.

Figure 5:
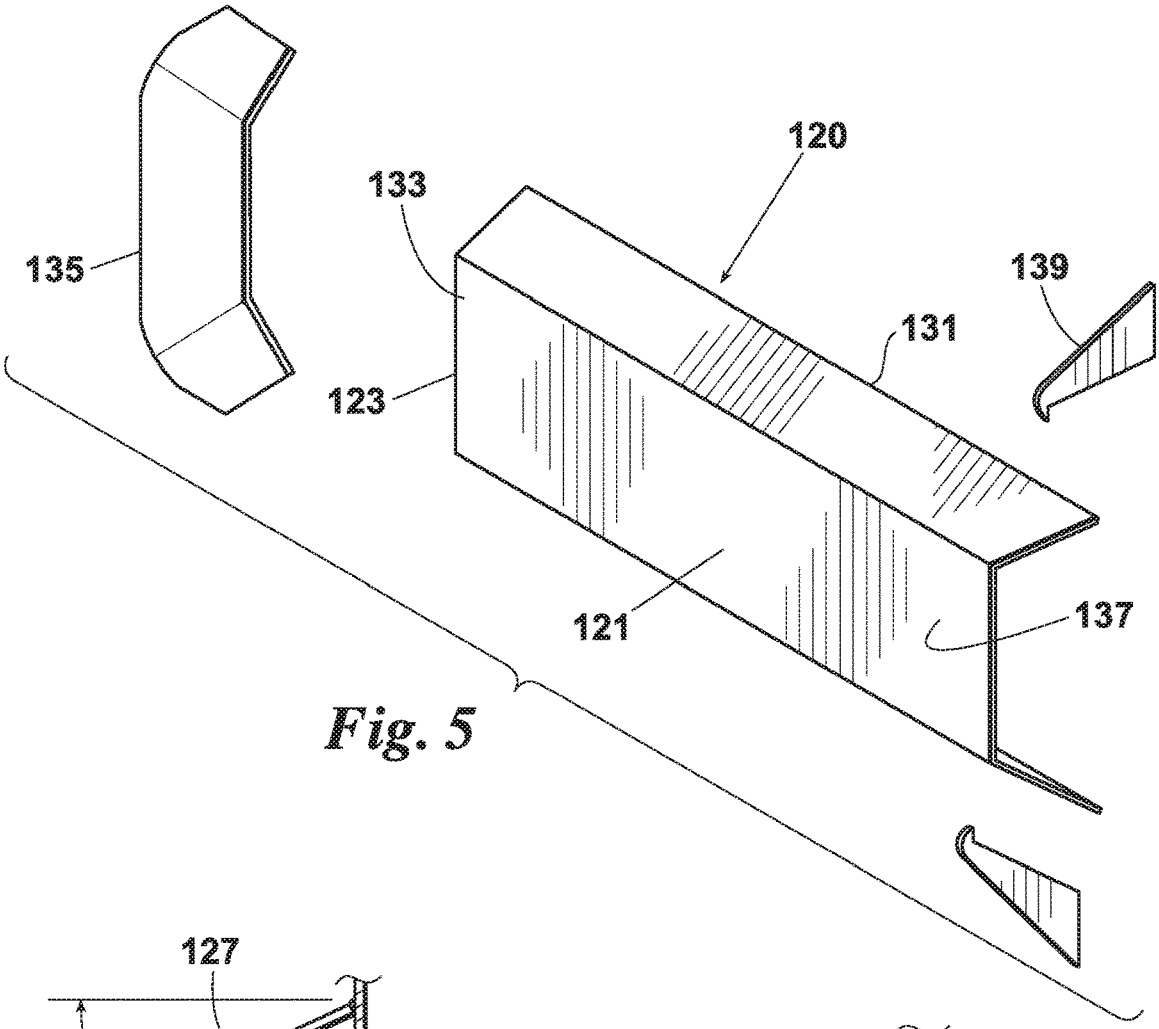
FIG. 5 is an exploded view of the lift pocket of the refuse container of FIG. 4. The lift pocket requires about 10 feet less of total welding relative to the prior art lift pocket of FIG. 2.
Figure 6:
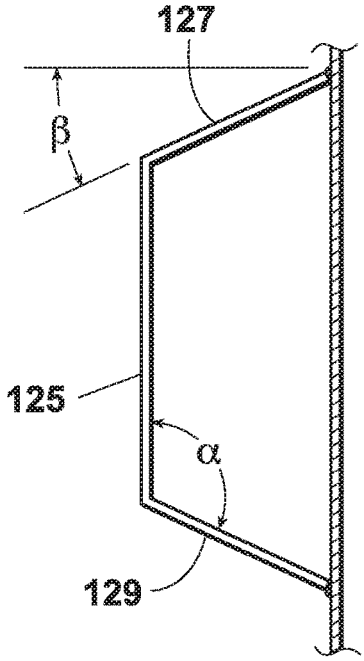
FIG. 6 is a side elevation view of the pocket or channel portion of the lift pocket of FIG. 4. The gusset portions of the lift pocket are angled relative to the end wall so as to eliminate the appearance of a step and prevent rocks or heavy objects from remaining on the lift pocket.

Referring now to FIGS. 5 and 6, a lift pocket assembly 120 for use with container body 11 includes a channel or pocket 123 integrally formed from a single sheet 121, thereby improving its aesthetics, increasing the strength of the lift pocket 120 and eliminating the need for welding in order to form the pocket 123. The forward end 133 of pocket 23 receives the forks of a refuse truck (not shown) and has a blunderbuss-shaped gusset 135. The blunderbuss-shaped gusset is formed from a single sheet 137. A pair of triangular-shaped gussets 141 is welded to the pocket 123 at a rearward end 139.

Figure 2:
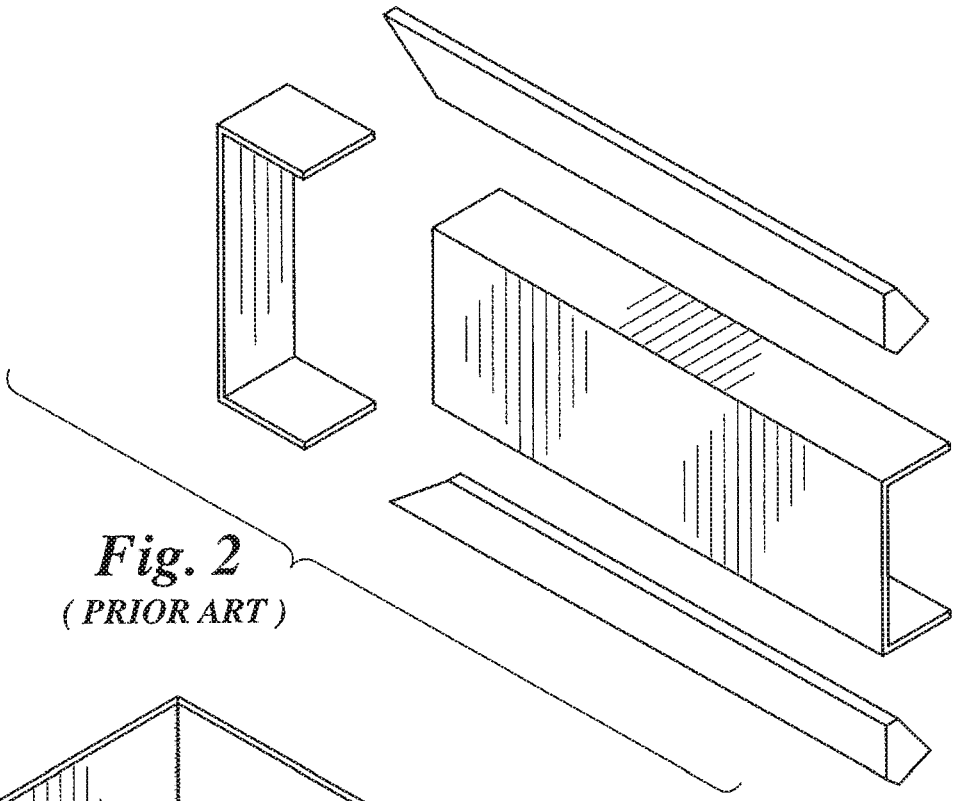
Fig. 2 ( PRIOR ART )
FIG. 2 is an exploded view of the lift pocket of the prior art refuse container of FIG. 1. The lift pocket requires about 225 inches of welding to fabricate the pocket and secure it to an end wall of the container.
Figure 3:
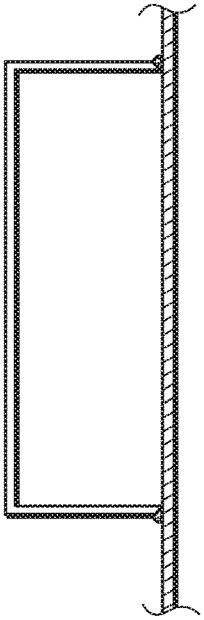
Fig. 3 ( PRIOR ART )
FIG. 3 is a side elevation view of the pocket or channel portion of the lift pocket of FIG. 1. The gusset potions of the lift pocket are at about a 90° angle to the end wall of the refuse container.

Unlike the prior art lift pocket of FIGS. 2 and 3, the upper and lower face surfaces 127, 129 of a pocket 123 made according to this invention are preferably angled relative to the front face surface 125 at an angle α. Preferably, angle α is about 115°. The 115° angle places the upper and lower face surfaces 127, 129 at about a 25° angle β from vertical when the longitudinal edge 131 of each face surface 127, 129 is welded to the end wall 13. This arrangement eliminates the appearance of a step and prevents rocks or heavy objects from remaining on the lift pocket 120. Preferably, angle β is in a range of 20 to 35°.

A lift pocket 120 made according to this invention requires about 100 inches less of welding per lift pocket than an equivalently sized prior art lift pocket (see FIGS. 2 and 3). The prior art lift pocket requires about 225 inches of total welding to fabricate a 27-inch pocket with gussets and attach it to the container body. A lift pocket 120 made according to this invention requires about 121 inches of total welding to fabricate the same size pocket and attach it to the container body. Additionally, less material is used.

What is claimed is:

1. A refuse container body comprising:

a continuous single sheet joined at opposing ends and forming a closed shape having four flat wall surfaces;

a corner formed by two adjacent walls in the four flat wall surfaces being a rounded corner; and further comprising a lift pocket having a forward end, an upper face surface, a lower face surface, and a front face surface; an interior surface of the upper and lower face surfaces being arranged oblique to an interior surface of the front face surface and, along with the interior surface of the front face surface, forming a half-hexagon shaped prong receiving channel adapted to receive and contact a prong of a forklift, said interior surfaces being prong-contacting interior surfaces of said half-hexagon shaped receiving channel;

said lift pocket affixed to a flat wall surface of said four flat wall surfaces;

a gusset affixed to said forward end of said lift pocket, said gusset extending away from said flat wall surface beyond said front face surface, above said upper face surface and below said lower face surface.

2. A refuse container body according to claim 1 further comprising a weld seam located along the joined opposing ends.

3. A refuse container body according to claim 1 further comprising the joined opposing ends lying on a face surface of one of the four flat wall surfaces.

4. A refuse container body according to claim 1 wherein:

said gusset is formed from a single piece.

5. A refuse container body comprising:

a closed bottom end;

an open upper end;

a front wall, a back wall, and two sidewalls connecting the closed bottom end to the open upper end; and a pair of lift pockets;

each lift pocket of the pair affixed to a corresponding sidewall of the two sidewalls and including:

a forward end, an upper face surface, a lower face surface, and a front face surface;

an interior surface of the upper and lower face surfaces being arranged oblique to an interior surface of the front face surface and, along with the interior surface of the front face surface, forming a half-hexagon shaped prong receiving channel adapted to receive and contact a prong of a forklift;

said interior surfaces being prong-contacting interior surfaces of said half-hexagon shaped receiving channel.

* * * * *